US008752358B2

(12) United States Patent
Cote et al.

(10) Patent No.: US 8,752,358 B2
(45) Date of Patent: Jun. 17, 2014

(54) THREADING A SADDLE LATIGO STRAP TO SECURE A SADDLE

(75) Inventors: Deborah L. Cote, San Jose, CA (US); Leah Ann Grey, Mountain View, CA (US)

(73) Assignee: Happy Horses LLC, San Jose, CA (US)

( * ) Notice: Subject to any disclaimer, the term of this patent is extended or adjusted under 35 U.S.C. 154(b) by 285 days.

(21) Appl. No.: 13/465,002

(22) Filed: May 6, 2012

(65) Prior Publication Data

US 2013/0291495 A1 Nov. 7, 2013

(51) Int. Cl.
*B68C 1/14* (2006.01)

(52) U.S. Cl.
USPC ..... 54/23

(58) Field of Classification Search
USPC ..... 54/4, 23, 46.1; 119/864; 24/30.5 P, 24/17 AP, 16 PB
See application file for complete search history.

(56) References Cited

U.S. PATENT DOCUMENTS

| | | | | | |
|---|---|---|---|---|---|
| 1,503,715 | A * | 8/1924 | Schnitger | 54/23 |
| 3,828,521 | A * | 8/1974 | Dulaney | 54/23 |
| 5,216,874 | A * | 6/1993 | Farrow | 54/46.1 |
| 5,396,684 | A * | 3/1995 | Yocom | 24/16 PB |
| 2005/0115028 | A1* | 6/2005 | Cheung | 24/16 PB |
| 2005/0120684 | A1* | 6/2005 | Sparacino | 54/46.1 |
| 2006/0130440 | A1* | 6/2006 | Horsey | 54/23 |
| 2008/0276432 | A1* | 11/2008 | McNeill | 24/16 PB |

* cited by examiner

*Primary Examiner* — Rob Swiatek
*Assistant Examiner* — Morgan T. Barlow
(74) *Attorney, Agent, or Firm* — Law Office of Dorian Cartwright

(57) ABSTRACT

A saddle latigo strap is threaded to secure a saddle. A body portion of a saddle latigo is looped through a permanent saddle rigging. A first end of the saddle latigo having a tapered portion is inserted through a second end. Notches of the body portion are engaged with holes of the first end to secure the saddle.

18 Claims, 9 Drawing Sheets

THREADING A SADDLE LATIGO STRAP TO SECURE A SADDLE

FIELD OF THE INVENTION

The present invention relates generally to latigo straps and, more specifically, a saddle latigo strap to secure a saddle to the back of a horse or mechanism.

BACKGROUND

Conventional Western or Australian-type saddles generally feature straps located on both sides of a saddle. One side of the straps is connected to the saddle while the other end of the strap is connected to a permanent rigging on the saddle and, in some conventional saddles, have buckles or rings disposed at the ends of the strap. The permanent saddle rigging is configured to receive a saddle latigo strap that is connected to a cinch wrapped along the underside of an animal and connected to a billet for securing the Western or Australian-type saddle to an animal such as a horse or mule.

Traditionally, saddle latigo straps are made of leather or some other suitable material. Conventional saddle latigo strap are often permanently affixed to a ring on a saddle while the ends are attached to a cinch wrapped along the underside of an animal and subsequently tightened and fastened to another ring on the saddle. This allows a saddle to be moved between different animals. Typically, a saddle cinch straps have a buckle and buckle holes that are used to fasten an end of a latigo strap to the back of a saddle.

However, some conventional saddle latigo straps can be difficult to secure when replacing. The original latigo strap typically wears out prior to other parts of the saddle assembly and needs to be replaced. Professionals may need to change a latigo once a year, or more. It is important for a saddle latigo strap to remain securely fastened to the saddle because a loosened latigo strap can result in a saddle shifting or coming loose during use, possibly causing injury to an animal or a rider.

Permanently affixing one end of the saddle latigo strap to a ring can require looping a saddle latigo strap through a ring and securing the saddle latigo strap using thin leather. To properly affix the latigo strap to the ring often requires special tools such as pliers to tighten or thread the leather because the threading is typically bigger than the holes. A sailors knot can attach the saddle latigo to the ring. This process often requires more than one person to manually tighten the thin leather sufficiently so that it does not come loose during use. Even when affixed correctly, the threading can loosen over time. Consequentially, the requisite tools, skill, and strength can make saddle latigo replacement difficult.

Thus, an improved solution for attaching the latigo strap to hardware is needed.

SUMMARY

To meet the above-desired needs, apparatus and methods are provided for threading a saddle latigo to secure a saddle.

In one embodiment of a method for threading a saddle latigo to secure a saddle, a body portion of a saddle latigo is looped through a permanent saddle rigging. A first end of the saddle latigo having a tapered portion is inserted through a second end. Notches of the body portion are engaged with holes of the first end to secure the saddle. Because the saddle latigo is self-supporting, no threading or tools are needed, and loosing does not occur. In one embodiment, the saddle latigo is an after-market part from a third-party manufacturer.

In another embodiment, the tapered portion can be rotated to a first angle that is substantially perpendicular to the second end while inserting. Afterwards, the tapered portion can be rotated to a second angle that is substantially parallel with a second end to secure the saddle latigo.

Advantageously, a saddle latigo can be quickly and easily replaced in a secure manner, and without the need for tools.

BRIEF DESCRIPTION OF THE DRAWINGS

In the following drawings, like reference numbers are used to refer to like elements. Although the following figures depict various examples of the invention, the invention is not limited to the examples depicted in the figures.

DETAILED DESCRIPTION

Embodiments or examples of the invention may be implemented in numerous ways, including as an apparatus (e.g., a saddle latigo), system (e.g., a saddle assembly), or process (e.g., a method for securing a saddle). A detailed description of one or more examples is provided below along with accompanying figures. The detailed description is provided in connection with such examples, but is not limited to any particular example. The scope is limited by the claims, but numerous alternatives, modifications, and equivalents are encompassed. Numerous specific details are set forth in the following description in order to provide a thorough understanding. These details are provided for the purpose of example and the descriptions provided may be used for implementation according to the claims without some or all of these specific details. For the purpose of clarity, technical material that is known in the technical fields related to the examples has not been described in detail to avoid unnecessarily obscuring the description.

Various examples of a saddle latigo strap (hereafter referred to as "latigo," "saddle latigo," or "strap" interchangeably) are described, including one or more notches and one or more openings. As described below, one or more openings may engage with one or more notches to secure one end of a saddle cinch to hardware connected to a saddle (e.g., a permanent saddle rigging). A saddle latigo may be wrapped along the underside of an animal and secured to another piece of hardware connected to a saddle. In some examples, tightening a saddle latigo may secure a saddle to the back of an animal (e.g., horse, mule, pony, camel, or any other type of animal or mechanism that may be used to mount or connect a saddle) to allow a rider to comfortably and safely ride. As described herein, the examples of a saddle latigo provided are not limited to the descriptions or embodiments provided and may be varied in design, function, structure, or implementation and are not limited to the techniques described below.

Figure 1:
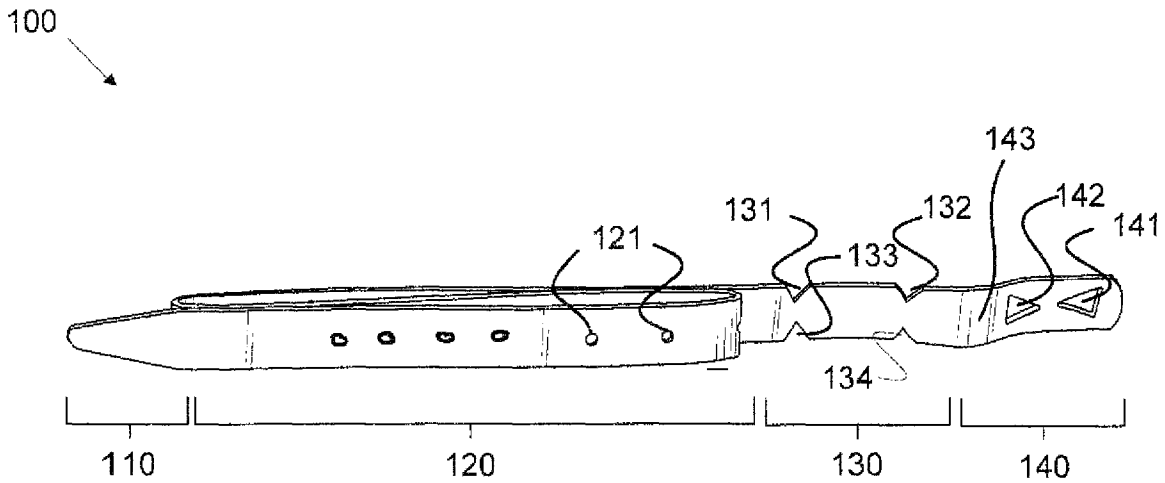
FIG. 1 illustrates a perspective view of an exemplary saddle latigo strap, according to one embodiment of the present invention.

FIG. 1 illustrates a perspective view of an exemplary saddle latigo strap. Here, saddle latigo 100 includes tapered portion 110, body portion 120, notched portion 130, securing portion 140, buckle holes 121, notches 131-134, and openings 141-142. In some examples, saddle latigo 100 may be made of a single continuous piece of material (e.g., leather, hide, cotton, wool, synthetic, or any other type of organic or synthetic material, fabricated or otherwise, without limitation). In other examples, different materials may be used for various portions or sub-portions of saddle latigo 100.

As shown here, tapered portion 110 may be disposed on one end of saddle latigo 100 and may be tapered in width. A tapered width of tapered portion 110 may be configured to ease the task of threading saddle latigo 100 through openings, such as openings 141-142 in securing portion 140. In some examples, tapered portion 140 may be implemented using a variety of tapered shapes including elliptical, circular, or pointed (as shown here). In other examples, tapered portion 110 may be formed using other shapes and are not limited to the design example shown. In yet other examples, tapered portion 110 may be implemented differently and is not limited to the examples shown and described.

As shown here, body portion 120 may be coupled to tapered portion 110. In some examples, body portion 120 may be rectangular in shape with a constant width in accordance with a permanent saddle rigging. As used herein, body portion 120 may also be referred to as "body." In other examples, body portion 120 may be other shapes with a non-constant width. The length of body portion 120 may vary depending on the use of saddle latigo 100. In some examples, body portion 120 may include buckle holes 121, which may be varied in shape, position, location, size, or other aspects, without limitation, and configured to receive a buckle (not shown). The buckle and buckle holes may allow the length of saddle latigo 100 to be adjusted in a similar fashion to a clothing belt. In other words, the buckle and buckle holes may be configured to allow for small adjustments to the length of saddle latigo 100, thereby allowing saddle latigo 100 to accommodate animals of slightly different size or girth. For example, a buckle and buckle holes may allow saddle latigo 100 to be wrapped around horses slightly different in girth. In some embodiments, multiple buckle holes 121 are shown in order to accommodate animals of slightly different sizes or girth are depicted. However, the number of buckle holes 121 may be varied and are not limited to the examples shown and described.

In some examples, body portion 120 may be made substantially or entirely of leather. In other examples, body portion 120 may be made of any other type of natural or synthetic material, regardless of whether the material is formed, tanned, treated, fabricated, or otherwise used to implement saddle latigo 100. In yet other examples, body portion 120 may be implemented differently and is not limited to the examples shown and described.

As shown here, notched portion 130 may be coupled to body portion 120. Notched portion 130 may be of constant or non-constant width and include notches 131-134 disposed along one or more edges. In some examples, notches 131-134 may create sections of notched portion 130 that are narrower than other sections of notched portion 130. Notches 131-134 may also be described as pairs of notches; specifically, notches 131 and 133 may be a first pair and notches 132 and 134 may be a second pair. In other examples, the quantity, shape, configuration, or other aspects of notches 131-134 may be varied and are not limited to the descriptions provided. For example, the number of notches 131-134 may vary depending on how saddle latigo 100 is used. If saddle latigo 100 is used to secure a saddle to a Clydesdale or other type of large horse, more notches may be required in order to adjust the length of a reinforced section once secured to, for example, a D-ring disposed at bend 143. In other words, when securing portion 140 is wrapped around a straight edge of a D-ring, for example, the tip of tapered portion 110 may be threaded first through opening 142 and then back through opening 141. In some examples, bend 143 may also be referred to as a loop or secure loop that is created when notches 131-134 are securely engaged with openings 141-142. When threaded or placed through openings 141-142, the sides of saddle latigo 100 engage notches 131-134 and create a secure reinforced portion that engaged a D-ring or other type of securing mechanism at bend 143 and tapered portion 110 and body portion 120 may be secured using a buckle attached to a saddle.

As shown, notches 131-134 may be configured to engage with openings 141-142, where the number of notches 131-134 and openings 141-142 may be adjusted to provide more or less tension when saddle latigo 100 is secured to a ring, buckle and/or other tack. Thus, some uses may require more notches while other applications may require fewer notches. For example, some applications may involve show riding while others may involve farming, carriage, or others. In some examples, the shape of notches 131-134 may be square, triangular, circular, or any other geometric shapes. In other examples, the configuration of notches 131-134 may be staggered, aligned, or placed in other configurations along the outer edges of notched portion 130. For example, as shown here, notch 131 and notch 133 may be located on opposing edges of notched portion 130 and implemented as triangular in shape. In some examples, notches 131 and 133 may be spaced approximately three, four inches, or any other distance apart. Likewise, notches 132 and 134 may be spaced similarly. In yet other examples, the shape, quantity, and configuration of notches 131-134 may be implemented differently and are not limited to the examples shown and described.

Here, securing portion 140 may be coupled or formed as part of saddle latigo 100. In some examples, securing potion 140 may be a constant or non-constant width and include openings 141-142 positioned along the interior of securing portion 140. In some examples, the configuration, shape, and number of openings may vary. Here, securing portion 140 may include openings 141-142 positioned substantially disposed about or along the center horizontal axis of saddle latigo 100. Alternatively, opening 141 or opening 142 may be disposed to either side of the center axis of securing portion 140. In some examples, openings 141-142 may be configured to engage with one or more notches of notched portion 130 to secure saddle latigo 100 to other hardware (e.g., tack) coupled to a saddle. Here, opening 141 may be configured to engage with notches 131 and 133 while opening 142 may be configured to engage with notches 132 and 134. In some examples, openings 141-142 may be engaged with one or more of notches 131-134 by mechanically wedging the tapered end (i.e., the tapered tip of tapered portion 110) of saddle latigo 100 in openings 141-142 between notches 131-134. By interleaving saddle latigo 100 through openings 142-142, an interlock may be created to secure bend 143 about a D-ring, for example. In some examples, opening 141 may engage with notches 131 and 133 by wedging opening 141 between notch 131 and notch 133. As openings 141-142 and notches 131-134 are configured to interact with each other to create an interlocking end for engaging a D-ring or another part of a saddle (e.g., the cinch of a Western saddle), the arrangement, position, configuration, or shape of openings of securing portion 140 and notches of notched portion 130 may be varied to accommodate different sizes and types of saddles, riders, or animals. For example, as shown here, openings 141-142 of securing portion 140 may be positioned such that the widest portion of each of openings 141-142 aligns with notches 131-134 of notched portion 130. In other examples, the shape and configuration of opening 141 and opening 142 may be implemented differently and are not limited to the examples shown and described. In yet other examples, notched portion 130 and securing portion 140 may be configured to engage with one another using different methods such as buttons, hooks, or other securing mechanisms. As described, saddle latigo 100 and the above-described elements may be varied with respect to the structure, function, configuration, size, disposition, or other aspects, without limitation to any of the specific examples provided.

Figure 2:
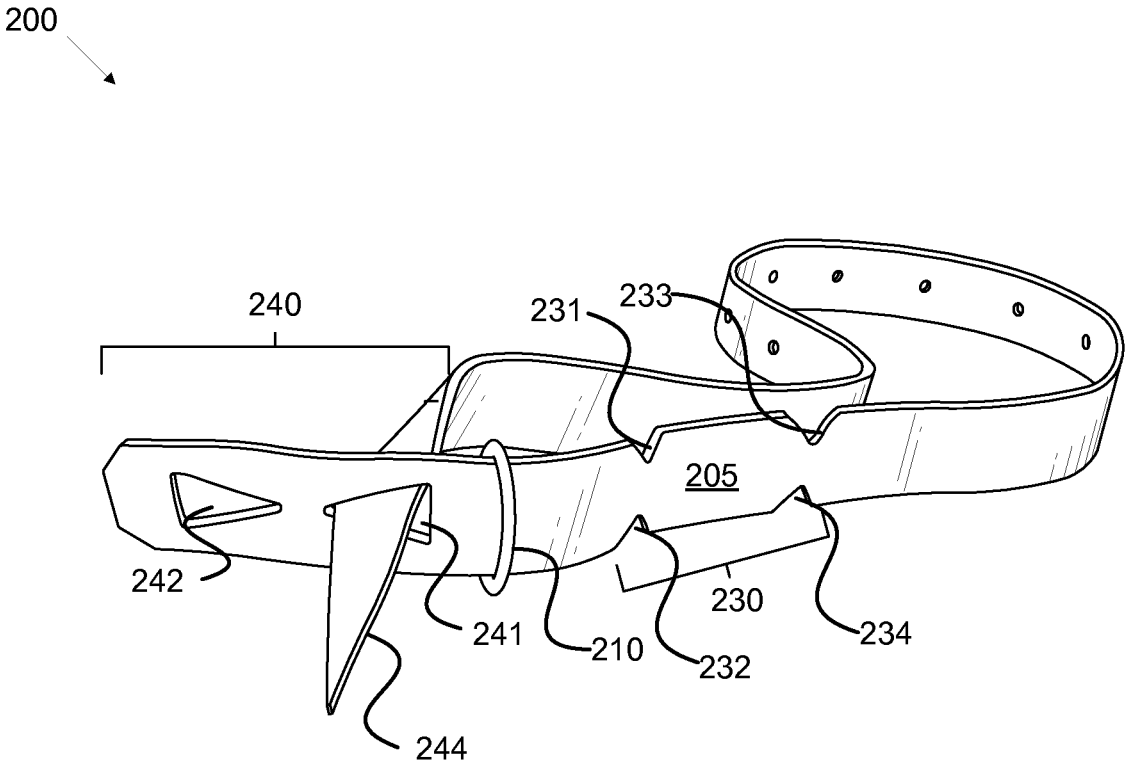
FIG. 2 illustrates another perspective view of an exemplary saddle latigo strap, according to one embodiment of the present invention.

FIG. 2 illustrates another perspective view of an exemplary saddle latigo strap. Here, saddle latigo 200 includes permanent saddle rigging 210, notched portion 230, notches 231-234, securing portion 240, openings 241-241, and tapered end 244. As shown here, saddle latigo 200 is in an intermediate state of being manipulated to create a latigo strap that can be used to secure a saddle to an animal. As shown, saddle latigo 200 is not connected to a saddle or animal, but is illustrated in its present state for purposes of illustration. In some examples, permanent saddle rigging 210 (e.g., D-ring, O-ring, or others) may be positioned in bend 143 (FIG. 1) between notched portion 230 and securing portion 240 such that when tapered end 244 of saddle latigo 200 is inserted into opening 241 and then interleaved into opening 242, permanent saddle rigging 210 is secured firmly. Although permanent saddle rigging 210 is shown in conjunction with saddle latigo 200 in FIG. 2 and the other figures for the purposes of illustration, permanent saddle rigging 210 can be fixed to a saddle. As a result, saddle latigo 200 can be replaced while using without changing permanent saddle rigging 210.

Tapered end 244 is shaped, in some examples, to facilitate the threading of body 205 of saddle latigo 200 through opening 241, enabling persons of varying physical strength, including children to easily secure a saddle to an animal. In other examples, the shape and configuration of tapered end 244 may be implemented differently and are not limited to the examples shown and described.

After tapered end 244 is inserted into a first opening (i.e., opening 241), tapered end 244 may be threaded through until body 205 is wedged between a first pair of notches (i.e., notches 231-232). In other words, notches 231-231 may be wedged (i.e., engaged) with opening 241, thus creating an interlock using notches 231-232 and opening 241. In some examples, an interlock is created between securing portion 240 and body 205. Although not shown, permanent saddle rigging 210 may be coupled directly or indirectly with a saddle and used to attach saddle latigo 200 when disposed securely in bend 143 as described above. In other examples, saddle latigo 200 and the above-described elements may be varied with respect to the structure, function, configuration, size, disposition, or other aspects, without limitation to any of the specific examples provided.

Figure 3:
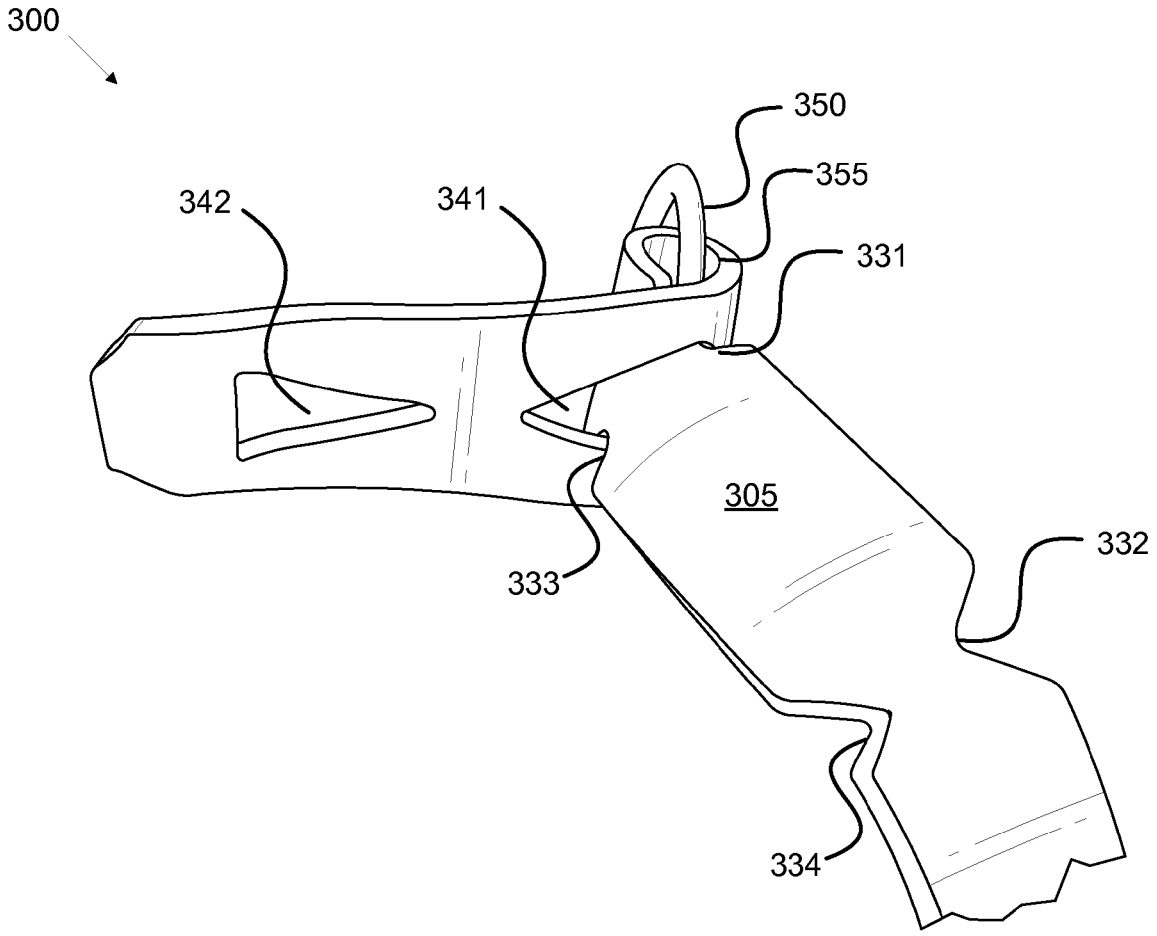
FIG. 3 illustrates a perspective view of a portion of an exemplary saddle latigo strap, according to one embodiment of the present invention.

FIG. 3 illustrates a perspective view of a portion of an exemplary saddle latigo strap. Here, saddle latigo 300 includes body 305, notches 331-334, openings 341-342, permanent saddle rigging 350, and bend 355. In some examples, body 305 may be threaded through opening 341 until notches 331 and 333 engage opening 341. When opening 341 is engaged with notches 331 and 333, saddle latigo 300 may be secured to permanent saddle rigging 350, which may be coupled, directly or indirectly, to a saddle (not shown). As shown, when body 305 is threaded (i.e., placed, positioned, or otherwise disposed) through opening 341 to engage notches 331 and 333, bend 355 is created in which permanent saddle rigging 350 is securely disposed. Permanent saddle rigging 350 may be attached to a saddle and used to secure one end of saddle latigo 300 and its opposing end (not shown) using a buckle, as described above.

Here, permanent saddle rigging 350 may be implemented using any type of ring, including, but not limited to D-rings, O-rings, or others. In some examples, the shape of opening 341 may be configured to accommodate varying dimensions of notched portion 330, body 305, notches 331-334, or other aspects of saddle latigo 300. For example, a configuration of opening 341 may allow saddle latigo 300 to travel freely when positioned in one angle through opening 341 but restrict movement of saddle latigo 300 when positioned in another angle through opening 341. Here, openings 341 and 342 may be substantially triangular-shaped, disposed along a center longitudinal axis, and configured such that one corner of each of openings 341-341 points towards one another. Opening 341 may also be triangular in shape with a long side substantially equal in length to a constant width of body 305 of saddle latigo 300 and a short side substantially equal in length to the distance measured between the interior tip of each of notches 331 and 333 or notches 332 and 334. This configuration allows saddle latigo 300 to travel with less restriction when body 305 is turned and inserted in opening 341 such that the plane of body 305 is perpendicular to the plane of opening 341 (or 342).

When inserted, body 305 is configured to create an interlock between notches 341-342 and openings 341-344. In other examples, the shape and configuration of openings 341-342 may be implemented differently and are not limited to the examples shown and described. For example, more notches and openings may be used to provide additional strength by increasing the length of overlapping portions of body 305, thus creating a stronger interlock. As another example, a shorter, lightweight saddle latigo strap may be desired and fewer notches may be used or the width of body 305 may be decreased. Further, multiple openings may be positioned in an alternative arrangement (as shown in FIGS. 2, 4-8) or in a uniform arrangement (e.g., isosceles triangle facing same direction). In still other examples, other variations may be envisioned and are not limited to any of those shown and described.

Figure 4:
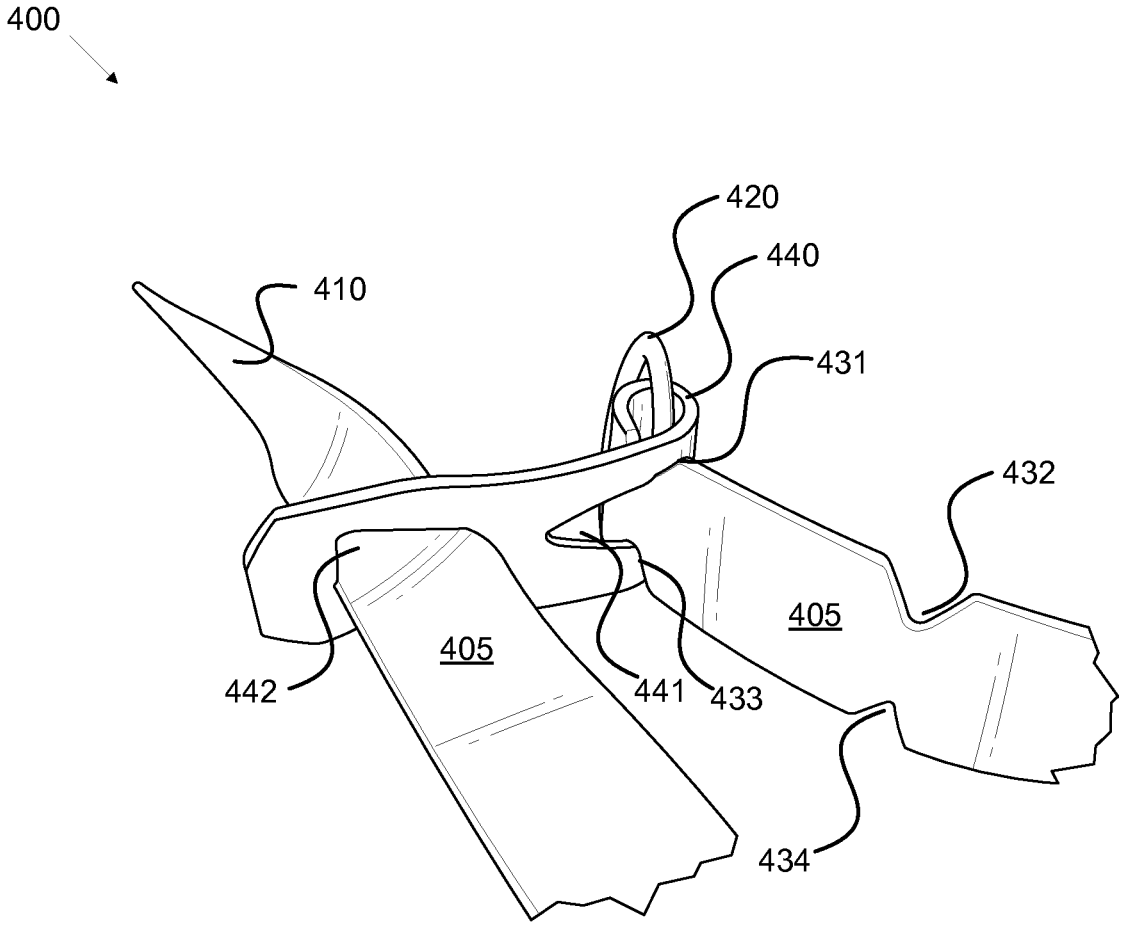
FIG. 4 illustrates an alternative perspective view of a portion of an exemplary saddle latigo strap, according to one embodiment of the present invention.

FIG. 4 illustrates an alternative perspective view of a portion of an exemplary saddle latigo strap. Here, saddle latigo 400 includes body 405, tapered end 410, permanent saddle rigging 420, notches 431-434, bend 440, and openings 441-442. In some examples, tapered end 410 may be inserted through permanent saddle rigging 420 and, subsequently, into opening 441. When body 405 is pulled through sufficiently (and the length of saddle latigo 400 may be varied), notches 431 and 433 engage opening 441 and to create an interlock and secure permanent saddle rigging 420. When tapered end 410 is next inserted into opening 442, body 405 may be pulled through until notches 432 and 434 engage to create another interlock (i.e., a wedge), thus creating a secure coupling between saddle latigo 400 and permanent saddle rigging 420, the latter of which may be attached to a saddle (not shown). In some examples, wedging additional openings between additional notches may provide added strength or security between the saddle cinch and the ring. In other examples, saddle latigo 400 and the above-described elements may be varied with respect to the structure, function, configuration, size, disposition, or other aspects, without limitation to any of the specific examples provided.

Figure 5:
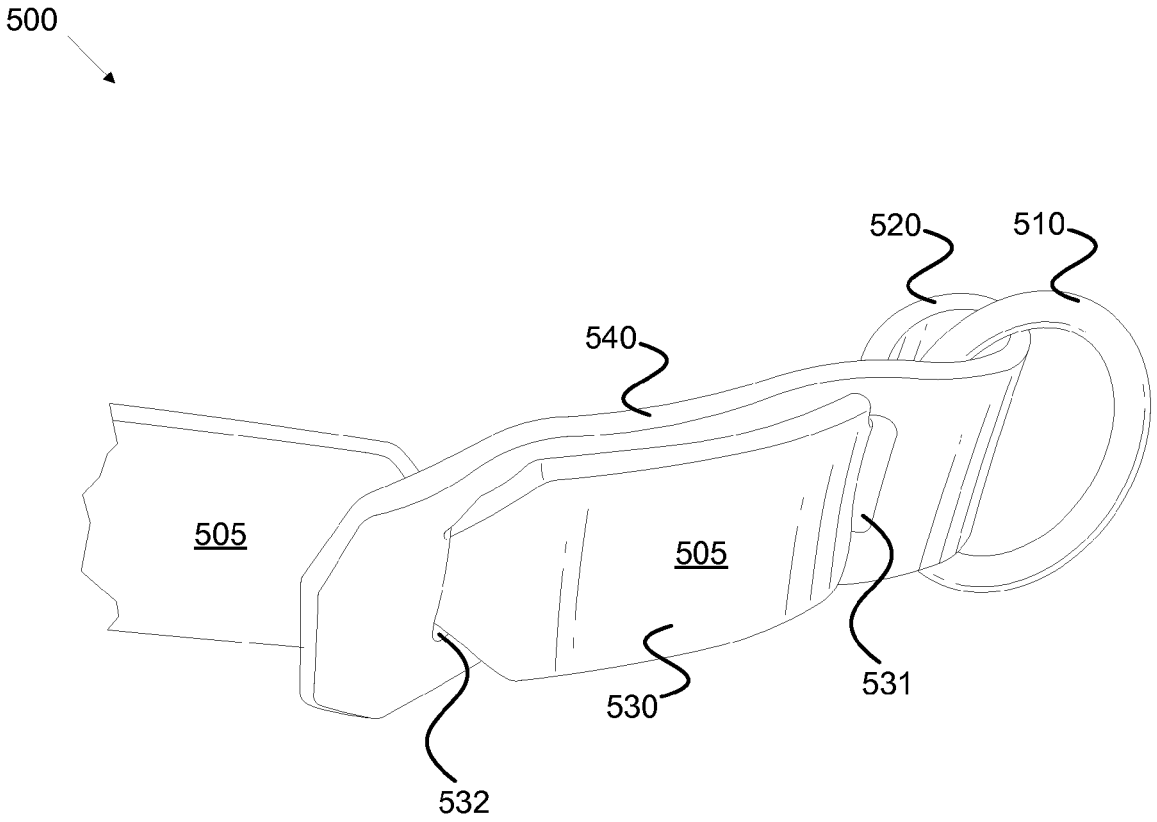
FIG. 5 illustrates another alternative perspective view of a portion of an exemplary saddle latigo strap, according to one embodiment of the present invention.

FIG. 5 illustrates another alternative perspective view of a portion of an exemplary saddle latigo strap. Here, saddle latigo 500 includes body 505, permanent saddle rigging 510, bend 520, notched portion 530, openings 531-532, and securing portion 540. As shown, permanent saddle rigging 510 is not part of saddle latigo 500, but is shown in the present illustration in a secure state and position when interlocks are created by interweaving body 505 of saddle latigo 500 in on itself as described herein. In some examples, when notches (e.g., notches 131-134 (FIG. 1)) are substantially engaged with openings 531-532, an interwoven, interlocking portion (i.e., a secured portion or interlock) is created between notched portion 530 and securing portion 540, which creates bend 520 around permanent saddle rigging 510.

As described above, more or fewer notches and openings may be used apart from those shown and described. Further, saddle latigo 500 and the above-described elements may be varied with respect to the structure, function, configuration, size, disposition, or other aspects, without limitation to any of the specific examples provided.

Figure 6:
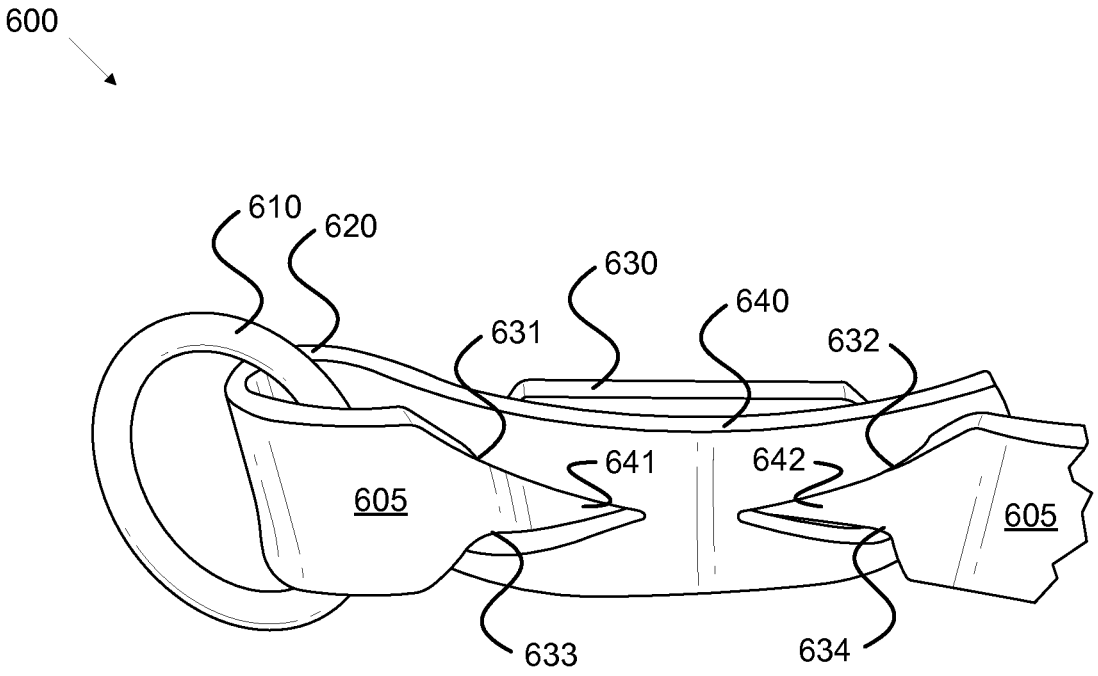
FIG. 6 illustrates yet another alternative perspective view of a portion of an exemplary saddle latigo strap, according to one embodiment of the present invention.

FIG. 6 illustrates yet another alternative perspective view of a portion of an exemplary saddle latigo strap. Here, saddle latigo 600 includes body 605, permanent saddle rigging 610, bend 620, notched portion 630, notches 631-634, securing portion 640, and openings 641-642. As shown here, saddle latigo 600 may be threaded through opening 642 until opening 642 is wedged (i.e., engaged) between notch 632 and notch 634. Opening 642 may be similar to opening 342 as shown and described above in connection with FIG. 3. In some examples, folding or bending saddle latigo 600 may facilitate threading saddle latigo 600 through opening 642. When opening 642 is wedged between notch 632 and notch 634, notched portion 630 may be substantially located on one side of saddle latigo 600 while securing portion 640 may be substantially located on an opposite side of saddle latigo 600.

As shown, the distance between a first pair of notches (e.g., notches 631 and 633) and a second pair of notches (notches 632 and 634) is approximately equal to the width of opening 641 and opening 642. In other examples, the distance may be varied and is not limited to the specific description provided. By configuring the distance between notches to be substantially equal to the widest portion of openings 641 or 642, notched portion 630 can be configured to sit flush and securely within securing portion 640 when saddle latigo 600 is secured. In other examples, the configuration, shape, and size of the notches and openings on saddle latigo 600 may depend upon one another. Once body 605 of saddle latigo 600 is pulled through both openings 641 and 642, bend 620 is created around which permanent saddle rigging 610 and saddle latigo 600 are secured. Saddle latigo 600, in other examples, and the above-described elements may be varied with respect to the structure, function, configuration, size, disposition, or other aspects, without limitation to any of the specific examples provided.

Figure 7A:
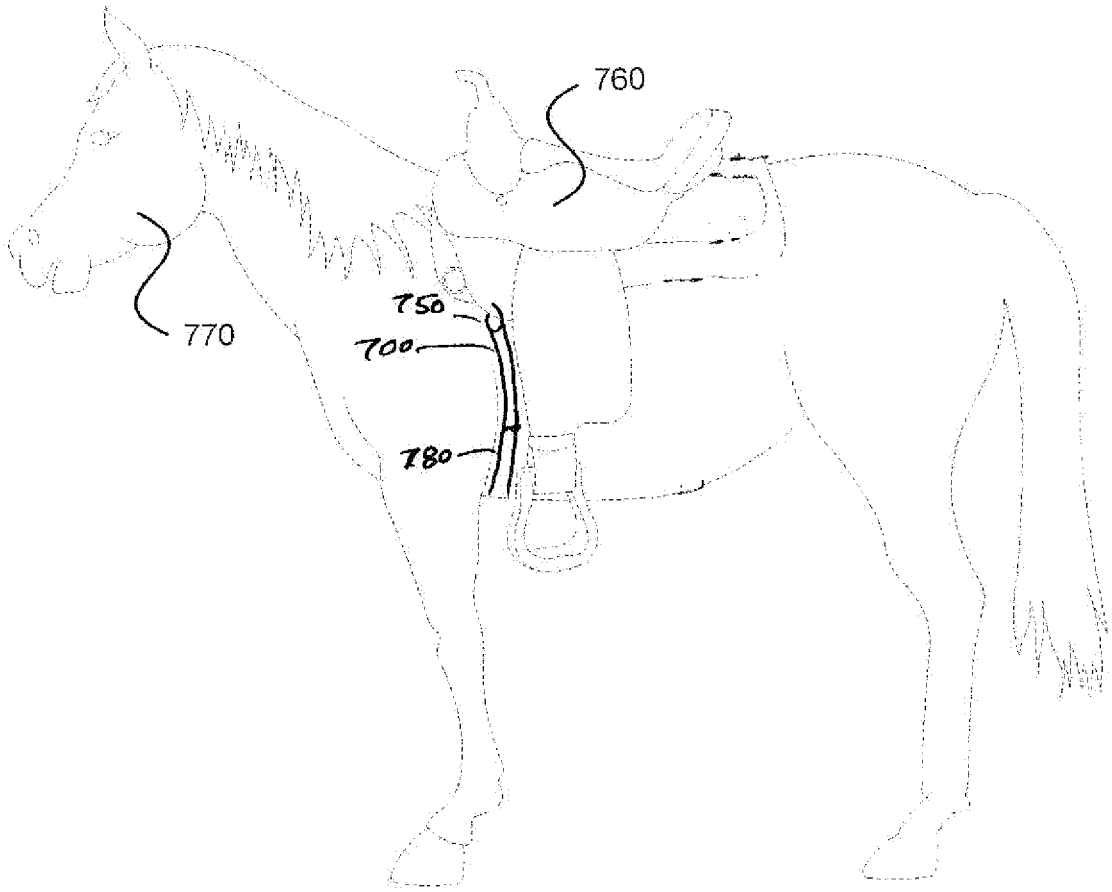
FIG. 7A illustrates a side elevation view of an exemplary saddle latigo strap attached to a saddle on a horse, according to one embodiment of the present invention.

FIG. 7A illustrates a side elevation view of an exemplary saddle latigo attached to a saddle 760 on a horse. Here, horse 770 is shown with saddle 760 secured using saddle latigo 700, which is attached to permanent saddle rigging 750, which is in turn coupled to a cinch 780. A billet 790 (see FIG. 7B) on the opposite side of horse 770, allows saddle 760 to be snugly secured to horse 770 by removing slack and securely tensioning saddle latigo 700.

Figure 7B:
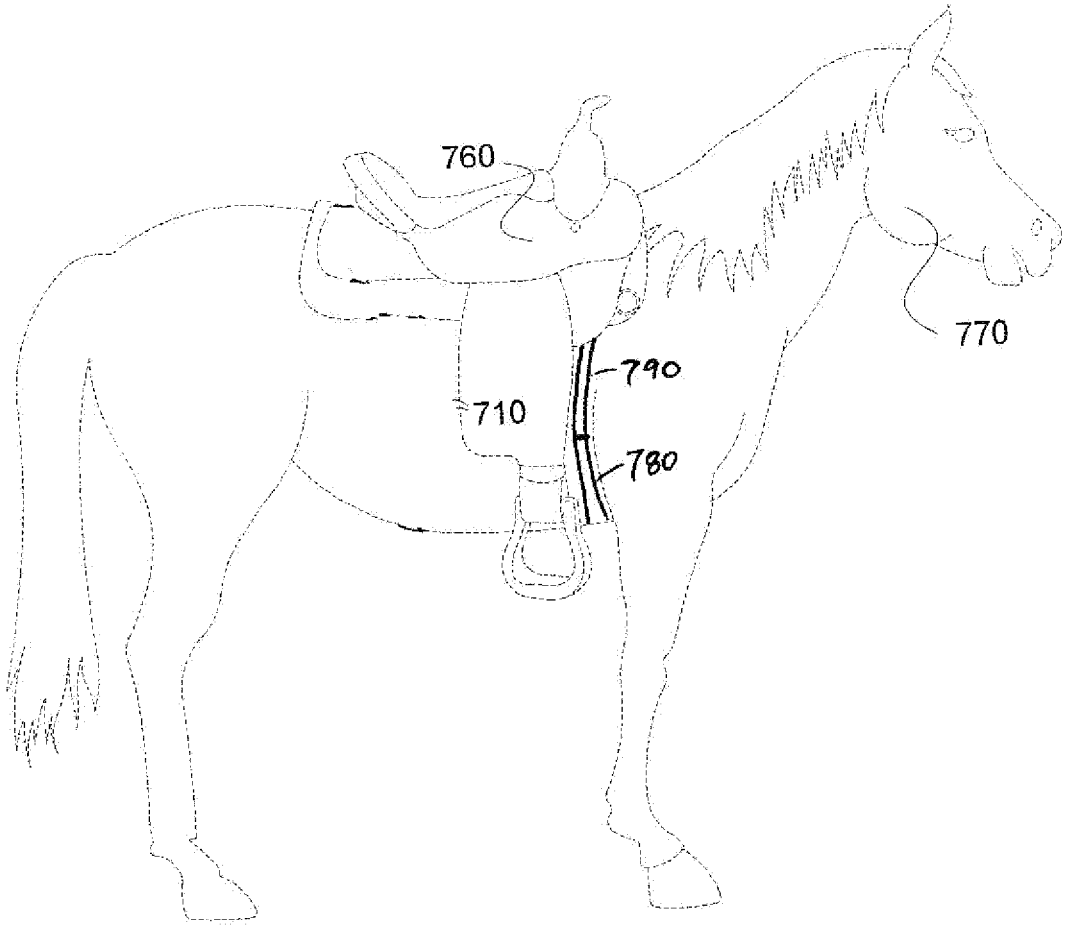
FIG. 7B illustrates an alternative side elevation view of an exemplary saddle latigo strap attached to a saddle on a horse.

FIG. 7B illustrates an alternative side elevation view of an exemplary saddle latigo strap attached to saddle 760 on horse 770. As shown, a billet 790 is securing saddle 760 to horse 770. In some examples, cinch 780 may be wrapped under the girth of horse 770 and secured to saddle 760 using billet 790 In other examples, the above-described configuration and implementation of saddle latigo 700 may be varied in structure, function, configuration, size, disposition, or other aspects, without limitation to any of the specific examples provided.

Figure 8:
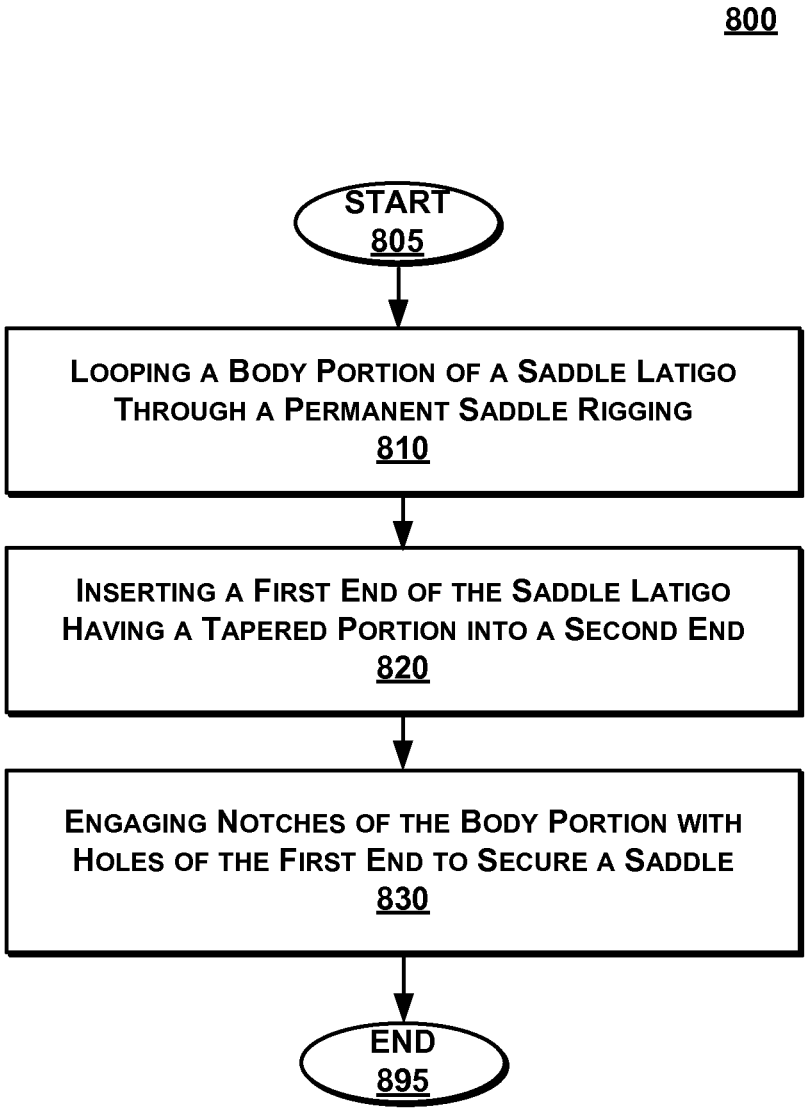
FIG. 8 is a flow chart illustrating a method of securing a saddle with a saddle latigo, according to one embodiment of the present invention.

FIG. 8 is a flow chart illustrating a method 800 of securing a saddle with a saddle latigo, according to one embodiment of the present invention.

At step 810, a body portion of a saddle latigo is looped through a permanent saddle rigging. In one embodiment, a saddle assembly is manufactured with an original saddle latigo that needs replacement due to wear and tear or other reasons. The original saddle latigo can be detached from the saddle assembly at the permanent saddle rigging at the same point where a replacement is looped.

At step 820, a first end of the saddle latigo having a tapered portion is inserted through a second end. The tapered portion allows the saddle latigo to be easily inserted into two holes of the second end. The holes can be triangular-shaped, with a width that exceeds a height. As a result, the tapered portion can be rotated to a first angle that is substantially perpendicular to the second end while inserting. The latigo strap can be tightened to a buckle hole according to a size of the animal or mechanism to which the saddle assembly is secured.

At step 830, notches of the body portion are engaged with holes of the first end to secure the saddle. In one embodiment, the tapered portion can be rotated to a second angle that is substantially parallel with a second end. By doing so, the notches are rotated from the length of the triangular-shaped holes to the smaller height, thereby locking the saddle latigo.

Alternative embodiments may include using other fastening or securing mechanisms to secure the notched portion of the saddle latigo to the securing portion of the saddle latigo. The other fastening or securing mechanisms may be compatible for heavy duty usage since the saddle latigo may experience extreme stress during normal use. Additional embodiments may include more or fewer sets of openings paired with notches to provide additional security or simplify the securing process.

As set forth above, measurements, dimensions, or other specifications may be varied and are not limited to those previously described. Variations in sizes, shapes, and processes may also be implemented and the above-described examples are also not intended to be limiting.

The foregoing examples have been described in some detail for purposes of clarity of understanding, but are not limited to the details provided. There are many alternative ways and techniques for implementation. The disclosed examples are illustrative and not restrictive.

What is claimed:

1. A saddle latigo, comprising:

a body portion of the saddle latigo comprising notches and having a width according to a width of a permanent saddle rigging, wherein the saddle latigo loops through the permanent saddle rigging;

a first end of the saddle latigo having a tapered portion; and a second end of the saddle latigo having holes sized to allow insertion of the tapered portion and also sized to engaged the notches, wherein the insertion and locking attaches the saddle latigo to the permanent saddle rigging.

2. The saddle latigo of claim 1, wherein the insertion and engaging attaches the saddle latigo to the permanent saddle rigging by hand without the use of any tools.

3. The saddle latigo of claim 1, wherein the holes comprise at least two sets of holes and the notches comprise at least two sets of notches on opposite edges of the body portion, and wherein the tapered portion is threaded through the at least two sets of holes such that each notch is engaged with a hole.

4. The saddle latigo of claim 1, wherein the holes of the second end have a height that varies from a width.

5. The saddle latigo of claim 1, wherein the holes are triangular-shaped.

6. The saddle latigo of claim 1, wherein the holes of the second end are sized to allow insertion of the tapered portion at a first angle, and are sized to engage the notches of the body portion at a second angle, wherein at the first angle, the tapered portion is substantially perpendicular to a width of the holes and a the second angle, the tapered portion is substantially parallel to a height of the holes to secure the saddle latigo.

7. The saddle latigo of claim 1, wherein the saddle latigo attaches to the permanent saddle rigging by looping through the body portion of the saddle latigo.

8. The saddle latigo of claim 1, wherein the body portion comprises buckle holes to allow a length of the saddle latigo to be varied when looping through the permanent saddle rigging.

9. The saddle latigo of claim 1, wherein the saddle latigo replaces an original saddle latigo of the saddle.

10. A method for threading a saddle latigo to secure a saddle, comprising:

looping a body portion of the saddle latigo through a permanent saddle rigging, the body portion comprising notches and having a width according to a size of a permanent saddle rigging;

inserting a first end of the saddle latigo into a second end, the first end having a tapered potion and the second end having holes sized to allow insertion of the tapered portion; and engaging each notch with a hole to attach the saddle latigo to the permanent saddle rigging, wherein the holes are also sized to engage the notches to secure a saddle.

11. The method of claim 10, wherein the insertion and engaging attaches the saddle latigo to the permanent saddle rigging by hand without the use of any tools.

12. The method of claim 10, wherein the holes comprise at least two sets of holes and the notches comprise at least two sets of notches on opposite edges of the body portion, and wherein the tapered portion is threaded through the at least two sets of holes such that each notch is engaged with a hole.

13. The method of claim 10, wherein the holes of the second end have a height that varies from a width.

14. The method of claim 10, wherein the holes are triangular-shaped.

15. The method of claim 10, wherein the holes of the second end are sized to allow insertion of the tapered portion at a first angle, and are sized to engage the notches of the body portion at a second angle, wherein at the first angle, the tapered portion is substantially perpendicular to a width of the holes and a the second angle, the tapered portion is substantially parallel to a height of the holes to secure the saddle latigo.

16. The method of claim 10, wherein the saddle latigo attaches to the permanent saddle rigging by looping through the body portion of the saddle latigo.

17. The method of claim 10, wherein the body portion comprises buckle holes to allow a length of the saddle latigo to be varied when looping through the permanent saddle rigging.

18. The method of claim 10, wherein the saddle latigo replaces an original saddle latigo of the saddle.

* * * * *